United States Patent [19]

Paulus

[11] 4,053,149

[45] Oct. 11, 1977

[54] DEVICE FOR SHORTAGE MONITORING INSIDE A SHEET COLLATOR

[75] Inventor: Jean Jules Henri Paulus, Brussels, Belgium

[73] Assignee: C. P. Bourg, Ottignies, Belgium

[21] Appl. No.: 627,296

[22] Filed: Oct. 30, 1975

[30] Foreign Application Priority Data

Sept. 24, 1975 Belgium ..... 160325

[51] Int. Cl.[2] ..... B65H 39/04

[52] U.S. Cl. ..... 270/58

[58] Field of Search ..... 270/58, 56; 271/64, 271/9, 173

[56] References Cited

U.S. PATENT DOCUMENTS

| | | | |
|---|---|---|---|
| 2,821,384 | 1/1958 | Mendes | 270/58 |
| 3,175,821 | 3/1965 | Gibson | 270/58 |
| 3,193,279 | 7/1965 | Campbell | 270/58 |
| 3,371,926 | 3/1968 | Anderson | 270/58 |

*Primary Examiner*—Edgar S. Burr
*Assistant Examiner*—A. Heinz
*Attorney, Agent, or Firm*—Weiser, Stapler & Spivak

[57] ABSTRACT

A shortage monitoring device for sheet collators having a flexible leaf normally contacting a movable rod which operates an electric microswitch, the leaf being deflected by a passing sheet out of contact with the rod which then operates to change the switching state of the microswitch.

12 Claims, 2 Drawing Figures

DEVICE FOR SHORTAGE MONITORING INSIDE A SHEET COLLATOR

This invention relates to a device for shortage monitoring inside a sheet collator, comprising a plurality of bins for loading sheet stacks, said bins being arranged underneath lower and upper members for guiding and conveying along a substantially horizontal path the sheets discharged from said bins, said shortage monitoring device comprising for each bin a flexible leaf which normally contacts a surface responsive to the presence thereof which is located in the path of the succeeding sheets between said guide and conveying members, said leaf and responsive surface being arranged on either side of said path in such a way that in the presence of a sheet said leaf no more contacts said responsive surface.

In the known collators, the lower guide members usually comprise metal baffles and the leaf which is also made of metal, normally directly contacts the baffle. When a sheet is discharged from a bin and reaches the leaf zone, said sheet raises the leaf thus breaking the contact which is part of an electric circuit which is cut-off when the sheet passes through. In case of shortage or lack of sheet, said electric circuit is not cut-off which results in stopping the assembler.

Said well-known system has for drawback an erratic operation due to insulating paper particles which can remain between the leaf and the sensor in such a way that even in case of shortage, the electric circuit is cut-off.

This invention has for object a shortage monitoring device which is devoid of said drawback.

For this purpose according to the invention, the shortage monitoring device comprises an electric microswitch having a movable rod to be operated by said leaf and arranged on that sheet side which is removed from the leaf side.

In a preferred embodiment of the invention, in that case where the lower guide and conveying members comprise as it is usual, for each bin, a roller in the sheet path at the bin outlet and an element with a substantially horizontal surface for the sheet movement between said roller and the roller of the adjacent bin along the sheet conveying direction, the leaves are comprised of springs with a tail which is mounted endwise on that element with a substantially horizontal surface which precedes the roller of the bin under consideration, said tail being extended by a slightly bulging area for passing round said roller, said leaf being terminated by a depending portion which is so arranged that in the absence of a sheet, it does depress the microswitch operating rod, said microswitch being arranged underneath the sheet-conveying surface of the adjacent element with a substantially horizontal surface, in the location of a port in said element, and it does bring said rod to a first position which corresponds to one of two possible microswitch conditions, while in the presence of a sheet between said microswitch and leaf, said rod lies in a position of extension relative to said first position, which corresponds to the second possible condition of said microswitch.

Other details and features of the invention will stand out from the description given below by way of non limitative example and with reference to the accompanying drawings, in which.

In the figures, the same reference numerals pertain to similar elements.

Figure 1:
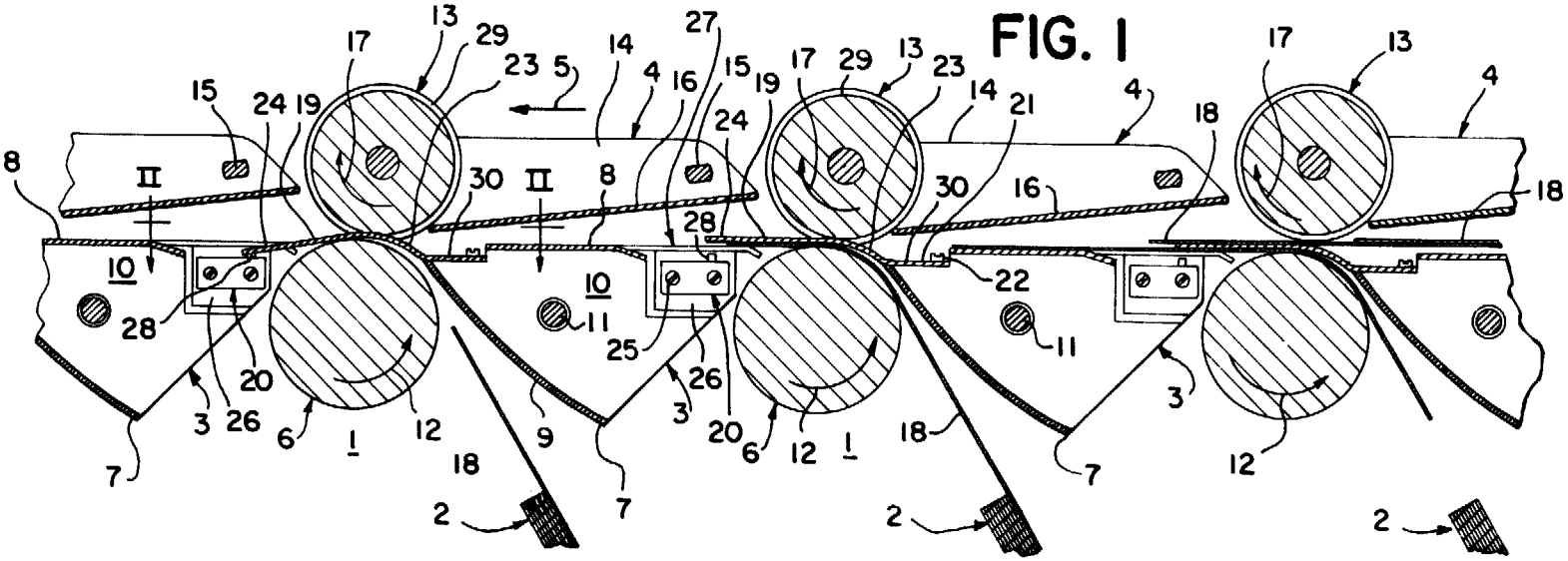
FIG. 1 is a diagrammatic elevation view in section of the top portion of a sheet collator, in the location where the shortage monitoring devices according to the invention are arranged.
Figure 2:
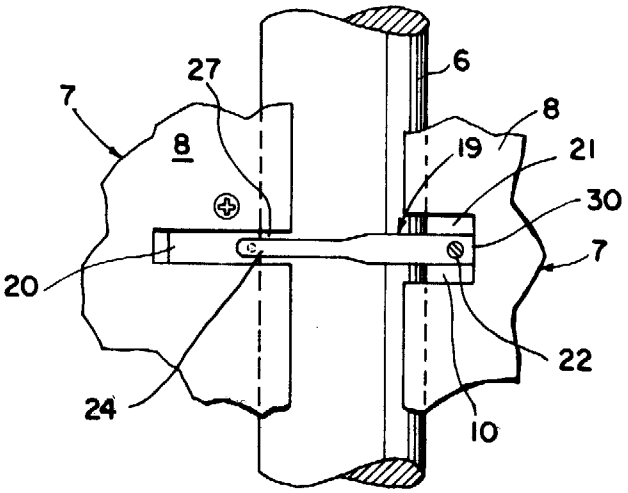
FIG. 2 is a part plan view according to line II—II in FIG. 1, the upper guide and conveying memebers being left out.

In FIG. 1 has been shown the top portion of a sheet collator of the type described in Belgian Pat. No. 795.185 in the name of the Assignee.

The collator is provided with bins 1 for loading sheet stacks 2 from which succeeding sheets are discharged by discharging devices not shown, towards lower and upper guide and conveying members 3 and 4 respectively, along a substantially horizontal path as shown by arrow 5, so as to for succeeding sheet bundles.

The lower guide and conveying members 3 comprise for each bin 1, a lower conveying roller 6 and a duck-bill shaped baffle 7 having a horizontal portion 8 and an upwardly-directed curved portion 9. In the location of the cross-section shown in FIG. 1, which lies substantially in the center of rollers 6, a block 10 forming a bearing for a shaft 11 which is part of the discharge device not shown, is fastened to each one of said baffles 7.

The rollers 6 are positively rotated along the direction shown by arrows 12.

The upper guide and conveying members 4 comprise counter-rollers 13 which are rotatably mounted in side arms 14 which are hinged in 15 to the collator frame. Said arms 14 bear upper baffles 16 which lie facing the horizontal portions 8 of lower baffles 7.

The counter-rollers 13 bear with the periphery thereof on the lower rollers 6 and they are thus rotated in the direction shown by arrows 17.

It is well known that with such an arrangement, the paper sheets 18 which are discharged in sequence from the bins 1, pass between the lower rollers 6 and the curved portions 9 of the lower baffles 7, then between the lower rollers 6 and the upper rollers 13 and finally between the horizontal portions 8 of the lower baffles and the upper baffles 16, to form a bundle which moves along the direction of arrow 5 to the collator top portion.

To monitor the absences of sheet discharge from succeeding bins, a shortage monitoring device has been provided for each bin.

Said device comprises on the one hand a flexible spring leaf 19 and on the other hand an electric microswitch 20.

Each leaf 19 has a tail 30 which is fastened endwise to the baffle 7 below the level where the paper sheets 8 pass; particularly, the duck-bill shaped end of baffle 7 is provided with an opening 21 and tail 30 of leaf 19 is fastened with a screw 22 to a flat part of block 10. Said leaf tail 30 is extended by a bulging portion 23 beyond which said leaf extends between the rollers 6 and 13 adjacent to the baffle towards the collator outlet. For this purpose, the upper roller 13 is provided with a circumferential groove 29 with a width which is somewhat wider than the leaf width. The leaf 19 terminates in a depending end portion 24. The microswitch 20 is fastened by means of screws 25 inside a recess 26 provided in each block 10 in the location of a cut-out 27 in the horizontal portion 8 of baffles 7. The microswitch 20 has an upstanding operating rod 28 which can lie in two positions that determine the microswitch condition. The one condition which corresponds to the closing of the electric circuit the microswitch is part of, is obtained when the rod 28 is pushed-in under the action of the leaf 19 the end 24 of which bears on said rod as shown for the leaf 19-microswitch 20 combination shown on the left in FIG. 1, in the absence of a sheet being discharged. The second condition of microswitch 20 which corresponds to the cutting-off of the electric circuit, is obtained with the extension of the microswitch rod 28, said extension position being taken by said rod 28 as soon as the leaf 19 leaves the rod as a result of the passage of a sheet 18 between the leaf and the lower guide and conveying means 6, 7, as shown for the leaf-microswitch combinations in the center and on the right in FIG. 1.

The microswitches 20 are arranged with a wide enough spacing below the paper sheet passage level on the substantially horizontal portion 8 of the lower baffles 7, to avoid the rod 28 thereof in the extension position interfering with the paper sheet passage.

There has been described a very simple shortage monitoring device for a collator, which is based on a mechanical interaction between the element responding to the paper sheet passage, that is leaf 19, and the element responding to the contact with said leaf, that is operating rod 28 of microswitch 20. Said shortage monitoring device has a reliable working.

It must be understood that the invention is in no way limited to the above embodiments and that many changes can be brought therein without departing from the scope of the invention has defined by the appended claims.

For instance the upper guide and conveying members 4 could have the shape of a belt with horizontal runs. Moreover, the lower guide and conveying members could be provided with a slanting sliding surface for the sheets.

I claim:

1. Device for shortage monitoring inside a sheet collator having a plurality of bins for holding sheet stacks, said bins being arranged underneath lower and upper guiding and conveying members forming therebetween a substantially horizontal path for the sheets discharged from said bins, said shortage monitoring device comprising for each bin an elongated flexible leaf having a portion thereof positioned in said horizontal path, an electric microswitch, and a displaceable switch actuating means positioned between a movable end of leaf and the microswitch, said flexible leaf end normally contacting the switch actuating means which responds to such contact to be displaced in one direction to actuate the microswitch into one condition, said leaf end and switch actuating means being so positioned on opposite sides of said horizontal path that the presence of a sheet separates said leaf end from contact with said switch actuating means, said switch actuating means being responsive to such separation to be displaced in the direction opposite to said one direction to actuate the microswitch into another condition.

2. Device as claimed in 1, in which each bin has an outlet adjacent a lower guiding and conveying member, and in which the lower guiding and conveying members comprise, for each bin, a roller in the sheet path at the bin outlet and an element with a substantially horizontal surface for the sheet movement between said roller and the roller of the adjacent bin along the sheet conveying direction, each leaf being comprised of a spring having a tail which is mounted on that element with a substantially horizontal surface which precedes the roller of the bin under consideration, said tail being extended by a slightly bulging area for passing round said roller, said leaf having an end opposite the tail in the form of a depending portion which is so shaped that in the absence of a sheet lifting said depending portion, it depresses the microswitch actuating means, said microswitch being arranged underneath the surface of the said element with a substantially horizontal surface which is next adjacent along the sheet conveying direction, said element having a port underneath which the microswitch is positioned, and thereby brings said actuating means to a first position which corresponds to one of two possible microswitch conditions, while in the presence of a sheet lifting said depending portion said actuating means lies in a second position of extension relative to said first position, which corresponds to the second possible condition of said microswitch.

3. The device of claim 2 wherein the actuating means is a rod positioned below said port in the element.

4. The device of claim 3 wherein the leaf has a depending portion aligned with the port and the rod.

5. The device of claim 4 wherein the leaf has a bulging tail for passing around a roller.

6. The device of claim 5 wherein the depending portion is long enough to depress the rod through the port and thereby change the microswitch from one condition to another.

7. The device of claim 6 wherein the depending portion is at one end of the leaf.

8. The device of claim 7 wherein the leaf is fixedly attached at the end opposite the one end.

9. The device of claim 6 wherein the rod ends below the upper edge of the port.

10. The device of claim 1 wherein the conveying members comprise upper and lower rollers, the upper roller having a circumferential groove for receiving the leaf.

11. In a device for shortage monitoring inside a sheet collator, comprising a plurality of adjacent bins for holding sheet stacks, said bins being arranged underneath lower and upper guiding and conveying members forming therebetween a substantially horizontal path for the sheets discharged from said bins, said shortage monitoring device comprising for each bin an elongated flexible leaf a portion of which is located in said path between said guiding and conveying members, said leaf having a movable end which normally contacts a bearing surface, said leaf and said bearing surface being arranged on opposite sides of said path, the improvement wherein said device comprises for each leaf an electric microswitch capable of controlling an electric monitoring circuit, said microswitch having an operating rod having a top surface comprising said bearing surface, which operating rod has two positions, a depressed one corresponding to one of two possible microswitch conditions and an extended one corresponding to the other of said conditions, said microswitch being positioned with its operating rod out of said path for the sheets in both the depressed and the extended position, said leaf pushing said microswitch operating rod to its depressed position on contact therewith, said microswitch operating rod urging to its extended position in absence of contact with said leaf, and said discharged sheets engaging said leaf and moving it out of contact with said microswitch operating rod on being guided and conveyed along said path, thereby to permit the operating rod to assume its extended position.

12. In a device according to claim 11, wherein said members for guiding and conveying the sheets along a substantially horizontal path comprise lower and upper members, said lower members comprising rollers arranged in the path of sheets emerging from the bins and guiding elements with a substantially horizontal surface defining a sheet conveying surface, which extend each one between two adjacent rollers and have an upstream and a downstream edge, the downstream edge of each of said guiding elements and the adjacent roller defining a gap for passage of the sheets discharged from a bin, the improvement wherein each of said leaves is comprised of a spring having a tail which is mounted endwise on the downstream edge of one of said guiding elements, said tail being extended by a slightly bulging portion, for passing over that roller which is adjacent said downstream edge and ending in a depending portion, said microswitches being arranged with their operating rod underneath the sheet-conveying surface of said guiding element in the area of the upstream end thereof in the location of a port in each of said guiding elements, and said depending portion of said springs contacting said microswitch operating rods and urging said rods to their depressed position on absence of a sheet passing between said leaves and said microswitches.

* * * * *